United States Patent [19]

Englehart

[11] Patent Number: 4,998,388

[45] Date of Patent: Mar. 12, 1991

[54] PREFORMED UNITIZED CLOSET

[76] Inventor: Gregory R. Englehart, 12637 - 25A Avenue, Surrey, British Columbia, Canada, V4A 5R4

[21] Appl. No.: 147,158

[22] Filed: Jan. 21, 1988

[51] Int. Cl.[5] ..... A47G 29/02

[52] U.S. Cl. ..... 52/36; 52/79.1

[58] Field of Search ..... 52/34, 35, 36, 79.1, 52/79.5, 79.6

[56] References Cited

U.S. PATENT DOCUMENTS

| | | | |
|---|---|---|---|
| 2,712,863 | 7/1955 | Busch | 52/79.1 |
| 3,110,907 | 11/1983 | King | 52/35 X |
| 3,230,549 | 1/1966 | McMurtie et al. | 52/35 |
| 3,845,600 | 5/1973 | Moore | 52/34 X |
| 4,171,596 | 9/1977 | Varlonga | 52/79.1 |
| 4,236,772 | 12/1980 | Henson | 312/242 |

FOREIGN PATENT DOCUMENTS

| | | | |
|---|---|---|---|
| 760145 | 6/1967 | Canada | 52/79.1 |
| 2252006 | 5/1973 | Fed. Rep. of Germany | 52/79.5 |
| 1198619 | 7/1970 | United Kingdom | 52/79.1 |

*Primary Examiner*—David A. Scherbel
*Assistant Examiner*—Jerrold D. Johnson
*Attorney, Agent, or Firm*—Hughes & Multer

[57] ABSTRACT

A prefabricated unitized closet unit includes an interior molded compartment portion and an outer frame. The closet assembly is delivered to a building site and installed within a framed opening of a wall. The closet frame is fastened to upstanding studs forming the framed opening.

8 Claims, 4 Drawing Sheets

PREFORMED UNITIZED CLOSET

TECHNICAL FIELD

The present invention pertains to a preformed closet for installation during construction of a dwelling or other building.

BACKGROUND OF THE INVENTION

The conventional construction of a dwelling or other building is a relatively complicated process involving a number of steps. Typically, a foundation is laid, and then floor, wall and roof framework is attached to the foundation. After this, the structure is wired and plumbed, insulation is installed, and then a wall finish is attached to the framework. Typically, panels of gypsum wallboard are attached as the interior wall finish material. Still further, the wallboard is taped, textured and painted.

The construction of closets within the structure involves many of the aforementioned steps. In addition, closet construction can be comparatively expensive due to the number of odd-sized panels which form the closets.

It is therefore desirable to provide closet structures which are premade and then delivered to a building site for easy installation during building construction, thus eliminating much of the field labor expense.

A number of prefabricated structures have been disclosed. For example, U.S. Pat. No. 4,171,596 by Varlonga, pertains to a prefabricated room structure in which ceiling, sidewalls, floors and supports are fastened together for installation in a building under construction.

Prefabricated bathroom structures have been disclosed by King in U.S. Pat. No. 3,110,907; as well as by Eriksson in U.S. Pat. No. 3,633,323, in which the bathroom structure includes metal framework which can be repositioned after installation of the bathroom unit at the building site so as to support portions of the building.

Henson, in U.S. Pat. No. 4,236,772, discloses a prefabricated storage closet which is mounted within a rough opening or recess in the wall of a building under construction.

Another prefabricated room unit is disclosed by Lindingo in U.S. Pat. No. 3,585,767, in which the room unit is supported by lightweight elongated sheet metal elements of U-shaped construction.

Other prefabricated units include a bathroom unit disclosed in U.S. Pat. No. 2,712,863 by Busch, which is formed so as to engage structural support members in the building; as well as a building module which is fabricated in almost completed form at the factory in U.S. Pat. No. 3,778,528 by Heifetz et al.

Other prefabricated building materials have been disclosed by Borghi in U.S. Pat. No. 4,080,769, in which modular members are connected together in a selected manner to form walls, floors, or ceilings of a structure. In Auer, U.S. Pat. No. 2,902,328, individual sectioned members are connected together in a selected manner to form a storage cabinet.

Prefabricated structures which can be installed in a completed building include a portable bathroom which is placed adjacent to a doorway in a hospital room or the like, and which is disclosed by Simonson in U.S. Pat. No. 1,600,017. Furthermore, in U.S. Pat. No. 2,944,863 by Bertelsen, there is a closet which is pivotally mounted in a corner of a room to rotate between an open and a closed position.

Also, in U.S. Pat. No. 3,149,187 by Wood, there is disclosed a method of forming a wall structure made of an underlying board member and an overlying polymer composition.

SUMMARY OF THE INVENTION

The present invention pertains to a performed storage unit for installation within a framed opening of a wall. The storage unit includes an interior molded compartment portion which has first and second upstanding sidewalls which are integrally joined to an upstanding rear wall and roof. An exterior frame is positioned about the interior compartment portion. The exterior frame includes a lower base formed by first and second side plates which are connected to a transverse rear plate. The exterior frame also includes an upper portion formed by first and second side plates which are connected to a transverse rear plate. Furthermore, there is provided in the exterior frame, first and second upstanding posts which are connected between forward end portions of the first and second side plates of the upper portion and lower base, respectively. In addition, the closet includes means for connecting the interior compartment portion to the exterior frame. Also, there is provided means such as nails or screws, for fastening the first and second upstanding posts of the exterior frame to first and second upstanding studs which form the framed opening of the wall.

It is an object of the present invention to provide a preformed closet which is installed in the opening of a wall or other portions of a building.

BRIEF DESCRIPTION OF THE DRAWINGS

This and other objects and advantages of the present invention will become more readily apparent upon reading the following Detailed Description, in conjunction with the attached Drawings, in which:

FIG. 7 is an isometric view of another embodiment in which the closet unit includes an interior ledge, a shelf platform, as well as retaining collars and a horizontal pole for hanging clothes or the like;

Figure 2:
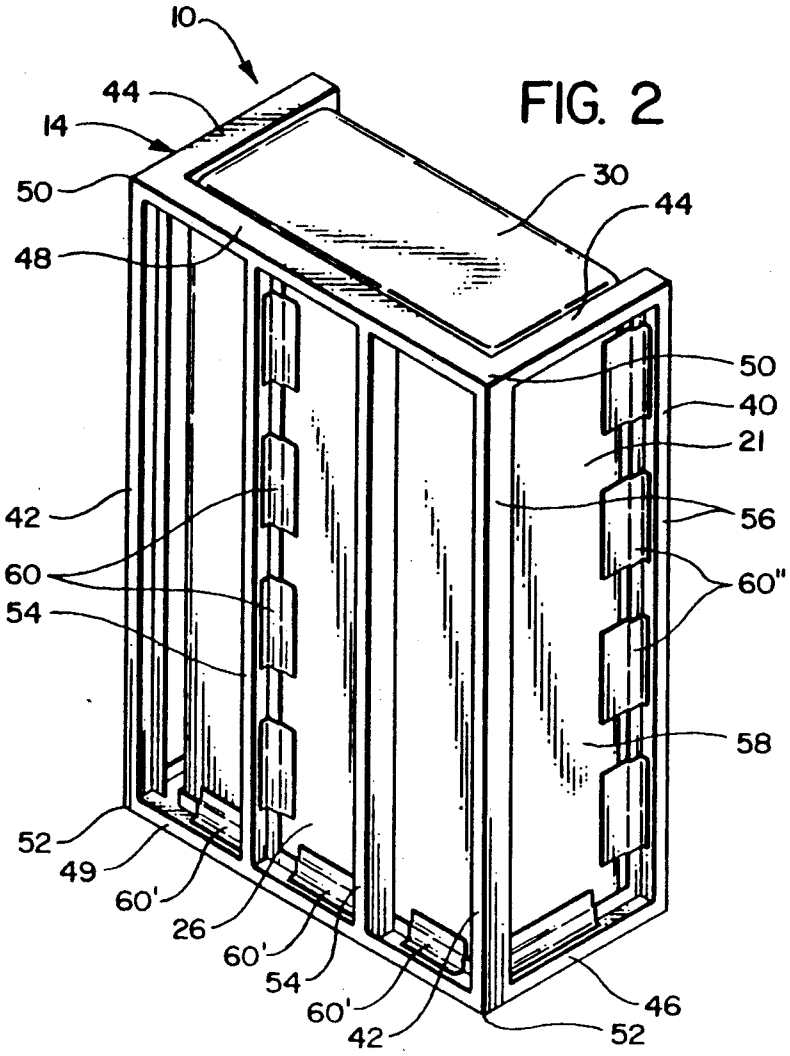
FIG. 2 is an isometric rear view of the closet unit.

While the present invention is susceptible to various modifications and alternative forms, specific embodiments thereof have been shown by way of example in the drawings and herein will be described in detail. It should be understood, however, that is not intended to limit the invention to the particular forms disclosed, but on the contrary, the intention is to cover all modifications, equivalents and alternatives falling within the spirit and scope of the invention.

DETAILED DESCRIPTION

Figure 1:
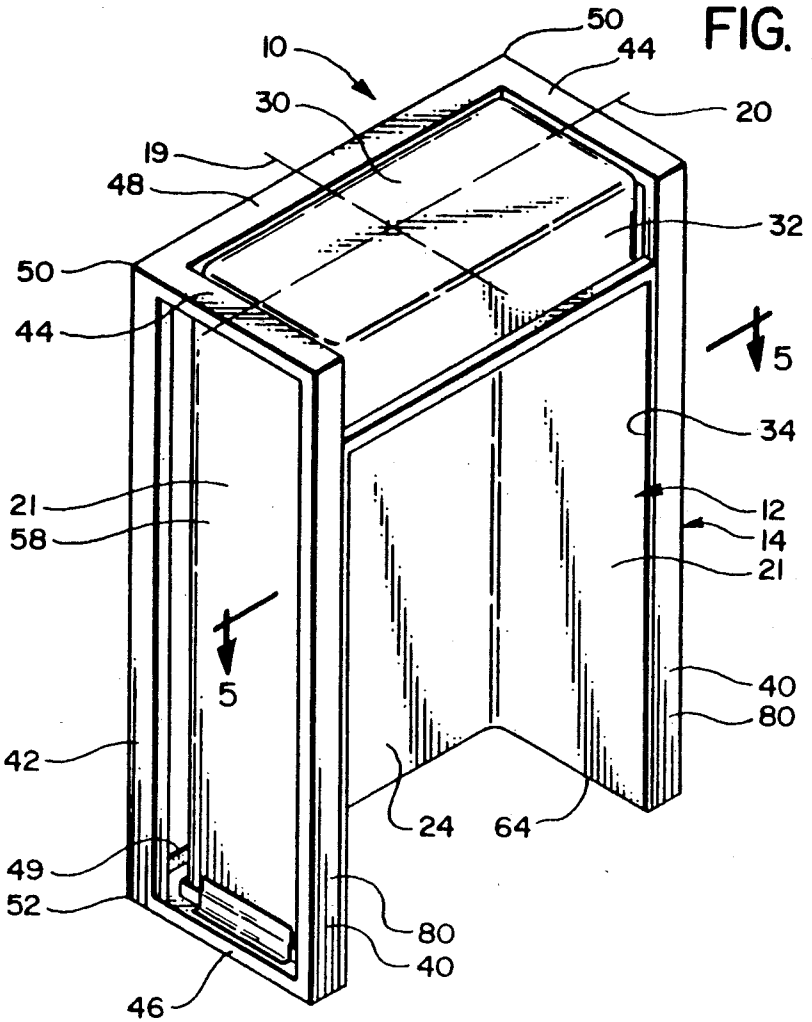
FIG. 1 is an isometric front view of an exemplary preformed closet unit of the present invention.

In the present invention there is provided a premade unitized closet unit generally indicated at 10 in FIG. 1, including an interior compartment portion indicated at 12, preferably made of molded plastic, which is connected to an outer lightweight frame indicated at 14 and which is preferably made of, but not limited to, steel. The closet 10 is a portable unit which is prefabricated and delivered in assembled form, as shown in FIG. 1, to a building site for installation.

Figure 3:
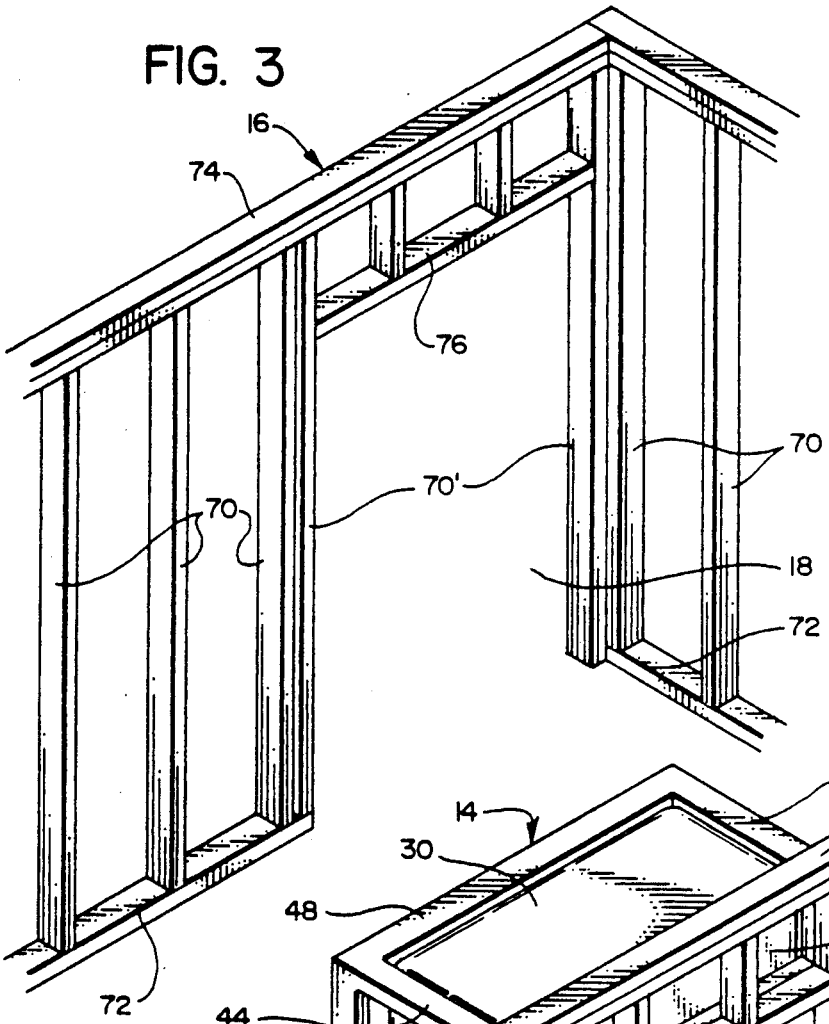
FIG. 3 is an isometric view of a conventional opening formed in a wall frame of a building.
Figure 4:
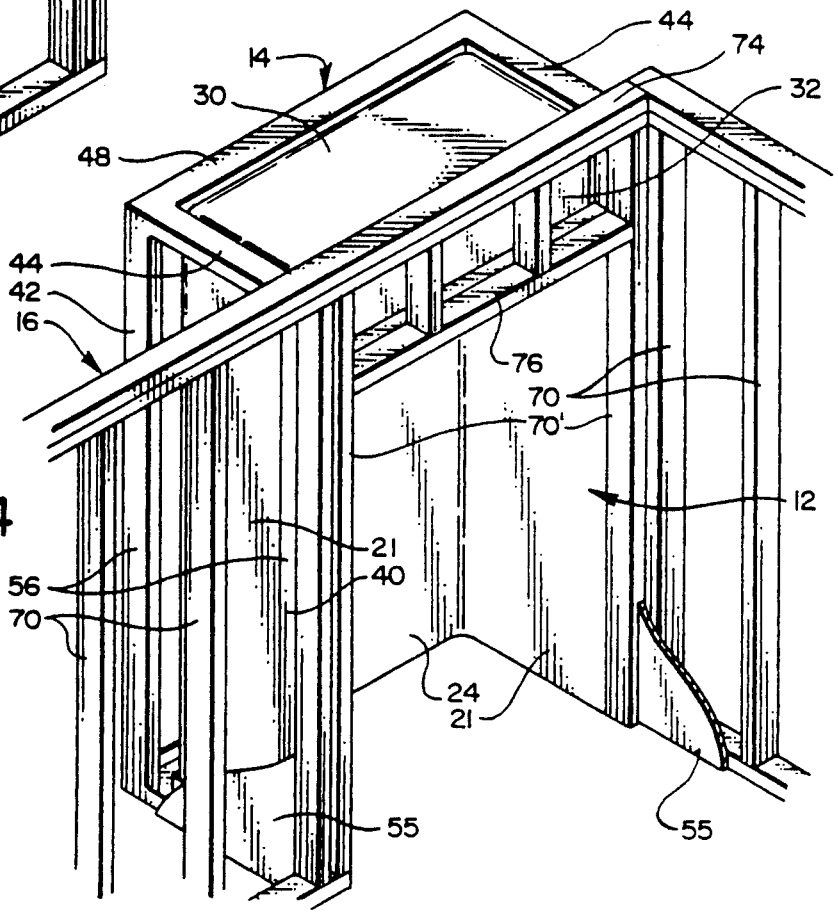
FIG. 4 is an isometric view showing the installation of the exemplary closet unit of the present invention within the structural opening described with reference to FIG. 3.

To facilitate installation, typically a building under construction includes a wall frame indicated at 16 (FIG. 3) having an opening 18 in which the closet is mounted as shown in FIG. 4. In this manner, there is no need to build a conventional closet by means of studs, gypsum wallboard, taping, painting and the like, as is done conventionally.

More particularly, as shown in FIGS. 1 and 2, the closet includes a lengthwise axis designated by a line having the number 19, and a transverse axis designated by a line having the number 20. The interior compartment portion 12 includes left, right vertical sidewalls 21 which are parallel to the lengthwise axis 19, and which are integrally connected to a vertical transverse rear wall 24 having a rear surface 26. Connected to the top of the sidewalls and rear wall is a roof including a horizontal rectangular member 30 which is integrally connected to the upper edges of the sidewalls and rear wall. The roof further includes a transverse front panel 32 which is connected to and extends downward slightly from the horizontal member 30 and which is connected between forward left, right vertical edges 34 of the interior compartment portion. In this manner, a closet opening is formed between the vertical edges 34 and the lower edge of the front panel 32.

Figure 6:
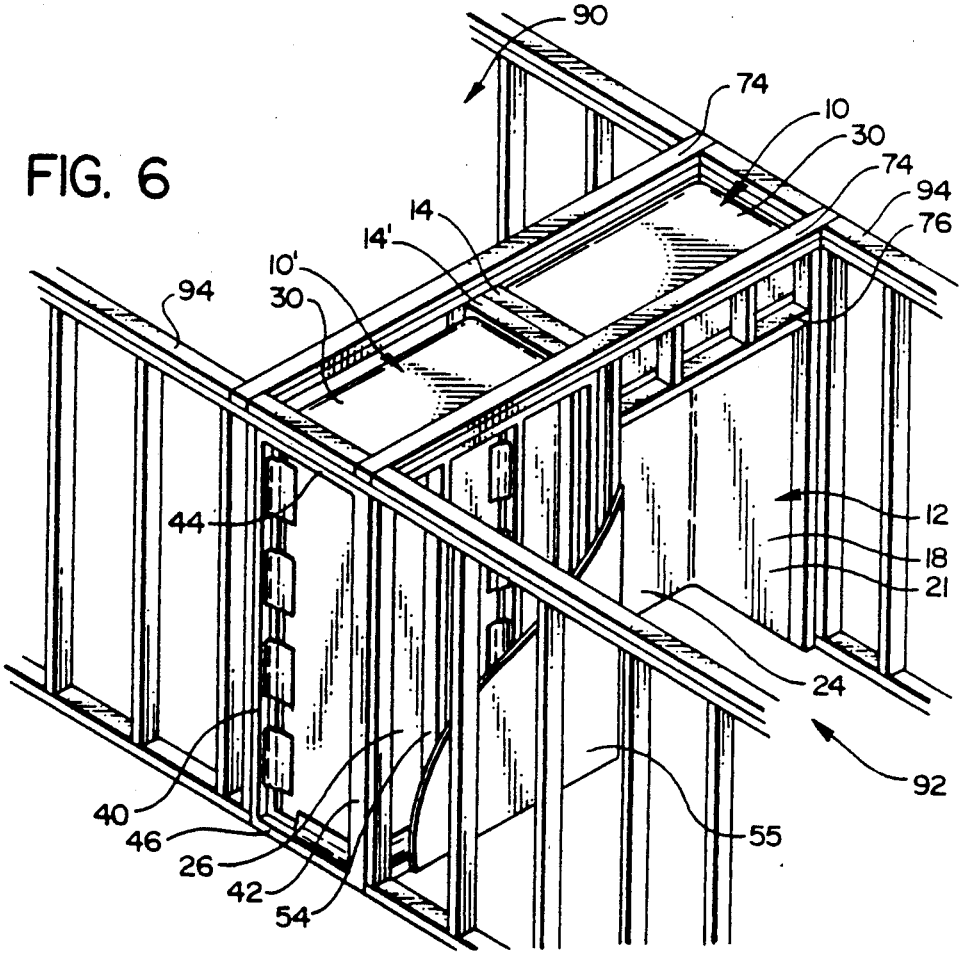
FIG. 6 is an isometric view showing theinstallation of two exemplary closet units to form a divider wall.

In order to support the interior compartment portion in an upstanding manner, the frame 14 includes left, right vertical front posts or studs 40, and left, right vertical rear studs 42. Connected to the front studs and rear studs (i) at their upper ends are left, right upper horizontal side members 44 which extend in a direction parallel to lengthwise axis 19, and (ii) at their lower ends are left, right lower horizontal side plates or members 46 which also extend in a direction parallel to the lengthwise axis 19. Further support is provided by an upper transverse rear plate 48 which extends between left, right upper rear corners 50 which are formed by the intersection of side plates 44 and rear vertical studs 42. An additional lower transverse rear plate 49 extends between lower left, right rear corners 52 formed by the intersection of vertical studs 42 and lower side plates 46. Additional support is provided by intermediate vertical backwall studs 54 which are connected between lower rear plate 49 and upper rear plate 48. Preferably the backwall studs are spaced apart at equal distances to provide support for the interior compartment 12 and wall board 55 attached to the rear surfaces of the upstanding studs 42, 54, as shown in FIG. 6, and side surfaces 56 of the upstanding studs 40, 42 as shown in FIG. 4.

The interior compartment 12 is supported within the U-shaped frame 14 so that the rear surface 5 (FIGS. 1 and 2) of rear wall 24 engages the forward transverse flat surfaces of the rear studs 54 and the rear plates 48 and 49. In addition, the outer surfaces 58 of the sidewalls 21 engage the inner lengthwise flat surfaces of the forward studs 40, as well as the inner lengthwise flat surfaces of the left, right side plates 46.

In an exemplary embodiment, the interior compartment 12 is made out of a fiberglass reinforced plastic resin (FRP) material. In a further exemplary embodiment, attachment of the interior compartment portion 12 to the frame 14 is accomplished by means of continuous spraying of fiberglass bonding strips to the frame and to the interior compartment. More specifically, as shown in FIG. 2, the strips 60 are bonded to the lengthwise side surfaces of the rear vertical studs 54 and to the transverse rear surface 26 of the rear wall 24 in a manner that the strips 60 form a 90° angle at the intersection formed by the sides of the rear studs 54 and the rear wall 24. Additional support is provided by lower strips 60' which are connected between the rear surface of the rear wall 24 and top horizontal surfaces of the lower rear plate 49 in a manner similar to that described with reference to strips 60. Additional strips 60'' are used to attach forward studs 40 to the outer flat surfaces of the sidewalls 21 in a manner that the strips 60'' are folded in a 90° direction at the intersection of the sidewalls 21 and the transverse rear surfaces of the forward posts 40. The frame is attached to the compartment portion so that the lower surfaces of the frame formed by the plates 46, 49 (FIGS. 1 and 2) are co-planar with bottom edges 64 of the interior compartment portion sidewalls and rear wall.

In an alternate exemplary embodiment, the interior compartment 12 is attached to the frame 14 by means of a sprayed foaming resin such as Celogen XP 100, manufactured by the Uniroyal Co.

Before describing the installation of the closet unit, a brief description of the wall framework 16 (FIG. 3) will be discussed. Typically, the wall frame is formed by a number of vertical posts 70 connected (i) at their lower ends to a horizontal floor plate 72 which, in turn, is fastened to the underlying foundation, and (ii) at their upper ends to an upper double horizontal plate 74. Opening 18 in the wall frame is formed by deleting a selected number of studs 70 and providing a header indicated at 76, where needed, which is formed by additional framing which is installed below the upper horizontal plates 74 and is attached to plates 74 and studs 70'.

Figure 5:
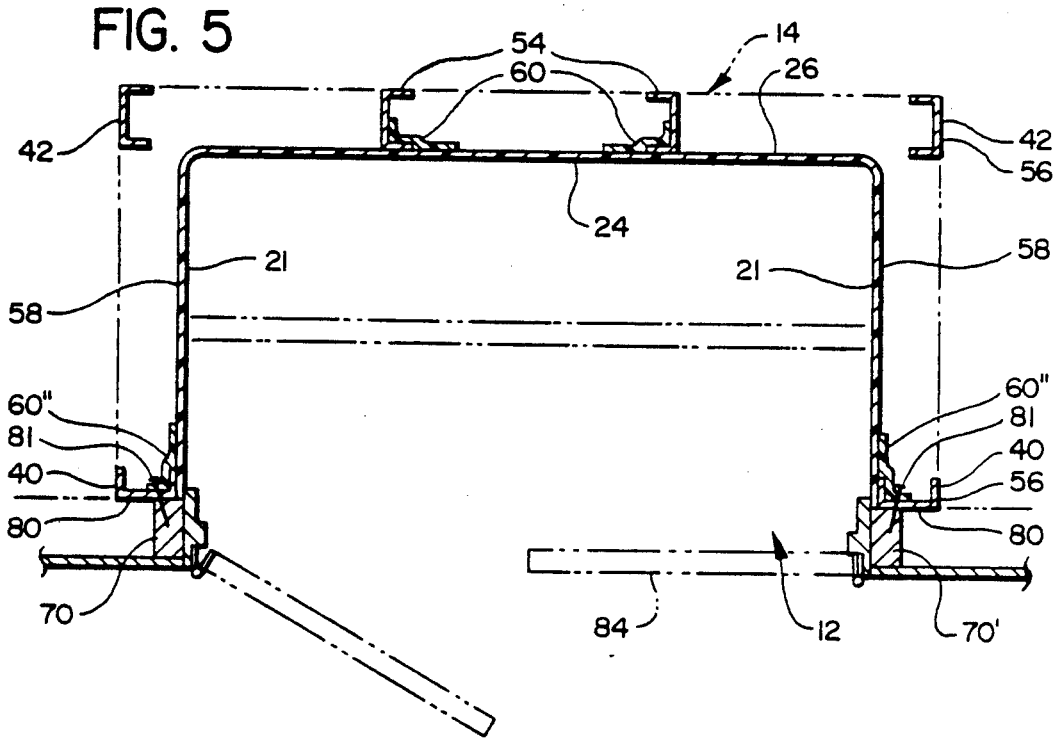
FIG. 5 is a top sectional view of the closet unit installed within the wall opening and including conventional forward doors.

When the closet unit 10 is received at the building site, it is transported by convenient means to the opening 18 and is mounted so that the lower edges 64 of the interior compartment, as well as the lower surface of the plates 46, 49 are supported directly on the upper surface of the floor. Furthermore, the closet is placed flush against the wall framing of opening 18 (FIG. 4) so that the forward transverse faces 80 (FIG. 1) of the forward studs 40 engage the rear transverse faces of the left and right studs 70' which form a portion of the opening 18. In this manner, the closet extends rearwardly of the wall frame opening. Furthermore, the lower forward edge of the cover 32 is positioned co-planar with the lower surface of the header framing 76. Fastening of the closet unit 10 to the wall frame is accomplished by fasteners 81 (FIG. 5) such as screws, nails, or the like, which are inserted through forward studs 40 into the rear faces of the opening framing studs 70'.

The closing of the closet opening is accomplished by means of any number of commercially available conventional door and trim molding panels 84 (FIG. 5) which are attached to the frame surrounding frame opening 18.

In another exemplary embodiment shown in FIG. 4, the conventional wall framework 16 and closet exterior frame 14 form a wall of the building structure. This wall may be completed by attaching wallboard 55, or the like, to opposite sides of the wall framework 16, as well as to the rear transverse faces of the closet frame studs 42, 54 (FIG. 2) and lengthwise side faces of the studs 40, 42. In this manner there is no need to provide conventional plates and studs about the closet, because this function is accomplished by means of the closet exterior frame.

In a further exemplary embodiment shown in FIG. 6, a pair of closet units 10, 10', are used to form a wall between rooms indicated at 90 and 92. The closets are positioned in a side-to-side manner to extend transversely between parallel wall framework 94, with the opening 18 of closet 10 facing into room 92 and the opening of closet 10' facing into room 90. More specifically, the upper, lower sideplates 44, 46, of the adjacent closet units are fastened together in abutting engagement so that the rear faces of the studs 42, 54 are co-planar with the header 76 of the adjoining closet. To complete the wall, wallboard 55, or the like, is applied to the rear faces of the studs 42, 54 and to the conventional headers.

Figure 7:
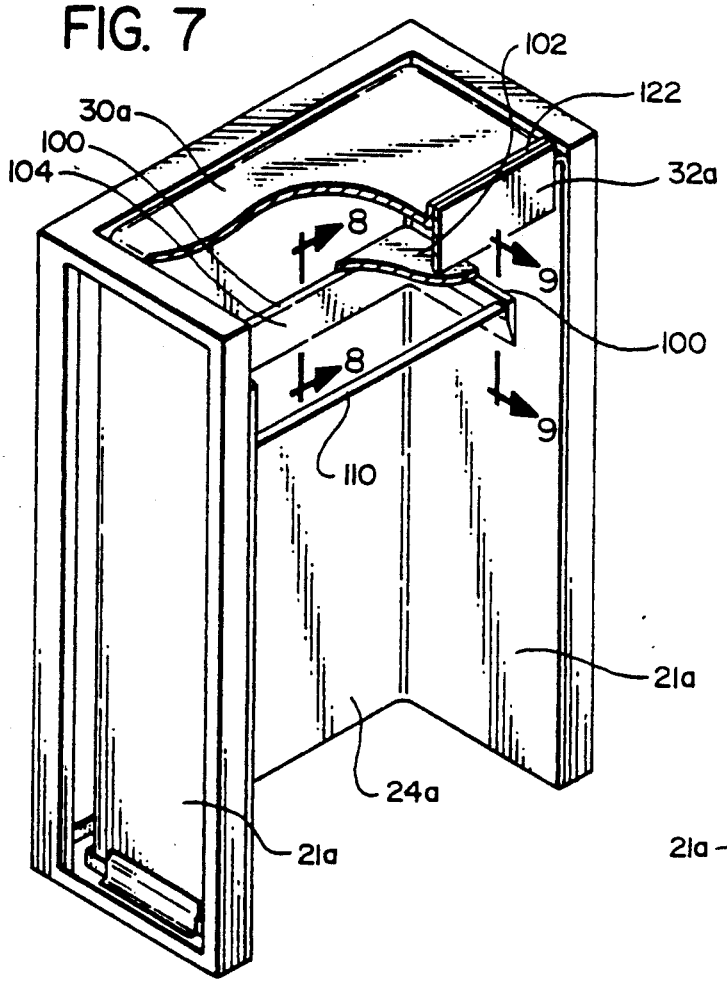
Figure 9:
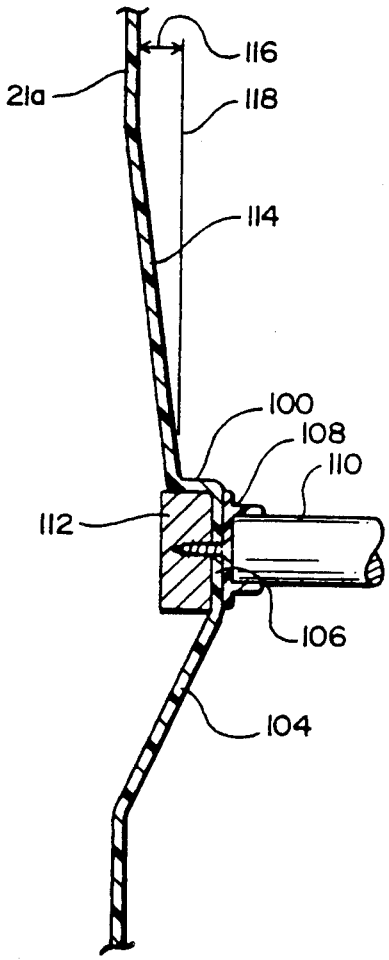
FIG. 9 is a side sectional view of the exemplary closet unit taken along line 9—9 of FIG. 8.
Figure 8:
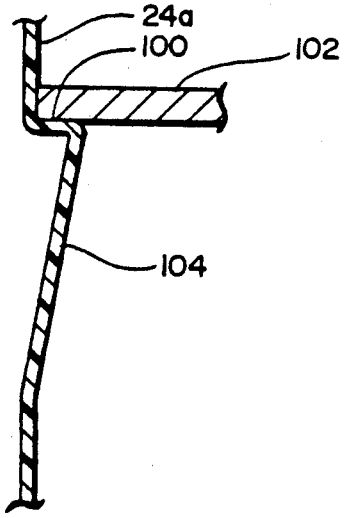
FIG. 8 is a side sectional view of the exemplary closet unit taken along line 8—8 of FIG. 7.

In another exemplary embodiment shown in FIGS. 7 through 9, the elements described in previous embodiments are designated by like numerals with the suffix "a " attached. In this embodiment, a horizontal ledge is formed about the interior surfaces of the closet sidewalls **21*a* and rear wall 24*a* by a conventional molding process. The horizontal upper surfaces 100 of the ledges support a removable horizontal platform 102 thereon. Each ledge includes a base portion 104 which tapers in an upward and inward direction from the inner surfaces of the sidewalls and rear wall. The ledges of the sidewalls 21*a* include vertical portions 106 to which cylindrical collars 108 are attached for supporting a horizontal pole 110** therebetween.

A wood block 112 is inserted just beneath the ledge 100 formed on the sidewall **21*a*, and this wood block is arranged to receive screws which would be inserted through flange portions of the related collar 108 and through the wall portion 106, so that the collar 108 can be properly retained. An alternative arrangement is to have the screw through the central portion of the collar, as shown in FIG. 9**.

Also, it should be noted that each portion 114 of the sidewall **21*a* that is positioned just above the ledge 100, has a downward and inward slope so that the corner line 118 at which the wall portion 114 meets the ledge 100 is spaced from the sidewall 21*a* by a distance (indicated at 116) of about three quarters of an inch. The reason for this is that the preferred dimensioning of the closet is such that the distance between the inside surfaces of the sidewalls 21*a* is made one and one half inches larger than an even foot dimension. Thus, if there is a nominal four foot closet, the interior dimension between the sidewalls 21*a* would be four foot one and one half inch. With this dimensioning, the inside surfaces of the sidewalls 21*a* would be flush with the adjacent surfaces of the studs against which the closet is mounted. Then, when it is desired to place a door in the front of the closet, a door jam having a thickness of three quarters of an inch can be placed in the doorway and connected to the adjacent wood studs, leaving a four foot door opening to accept a standard door. With the ledges 100 being spaced inwardly by three quarters of an inch, the distance between the interior corner line 118 at the two side ledges 100** is exactly four feet. Thus, a four foot shelf could be cut from an eight foot board, leaving a quite usable second four foot piece of lumber which could be used on a second shelf.

Further, it will be noted that the upper front wall **32*a* of the closet is formed so that its upper edge 120 extends upwardly from the top wall 30*a* a short distance, and joins to an upturned flange portion 122 of the top wall 30*a*. This is to illustrate an alternative arrangement to that shown in FIG. 1**.

It is to be recognized that various modifications could be made to the present invention without departing from the basic teachings thereof.

What is claimed is:

1. A performed storage unit, having a lengthwise axis and a transverse axis, for installation within a building wall frame opening which is formed by first and second spaced apart upstanding framing members, the storage unit comprising:

a. an interior compartment portion having an inner surface and an outer surface, and further including first and second upstanding sidewalls which are integrally joined to an upstanding transverse rear wall;

b. an exterior frame including an inner surface which is positioned about the outer surface of the interior compartment portion, and an outer surface, the exterior frame including (1) a lower base including first and second lengthwise horizontal members which are connected to a rear transverse horizontal member, (2) an upper base including first and second lengthwise members which are connected to a rear transverse horizontal member, and (3) first and second upstanding members which are connected between forward end portions of the first and second lengthwise members of the upper and lower base, respectively;

c. means for connecting the interior compartment portion to the exterior frame;

d. means for fastening the first and second upstanding members of the exterior frame to the first and second upstanding framing members;

e. said first and second upstanding sidewalls each including an integral horizontal portion supporting a platform thereon, said sidewalls each having a sidewall portion which slants downwardly toward an interior area of the interior compartment portion in a manner that edges of the two ledge portions that are adjacent to the two sidewalls are positioned more closely to one another than interior surfaces of said sidewalls other than the sidewall portions above the ledges, whereby the sidewalls of the closet may be made greater than a standard dimension, while the ledges are able to provide a support platform of a standard dimension.

2. A combination structure comprising:

a. a building framework comprising a pair of vertical posts which are spaced apart from one another to define an entryway area, said posts each have forward and rear surface portions and having lateral surfaces facing toward one another;

b. a preformed closet unit, having a lengthwise axis and a transverse axis, said unit comprising:
(1) an interior compartment portion having an inner surface and an outer surface, and further including first and second upstanding sidewalls which are integrally joined to an upstanding transverse rear wall;
(2) an exterior frame including an inner surface which is positioned about the outer surface of the interior compartment portion, and an outer surface, the exterior frame including
i. a lower base including first and second lengthwise horizontal members which are connected to a rear transverse horizontal member,
ii. an upper base including first and second lengthwise members which are connected to a rear transverse horizontal member, and
iii. first and second upstanding members which are connected between forward end portions of the first and second lengthwise members of the upper and lower base, respectively;
(3) means for connecting the interior compartment portion to the exterior frame;
(4) forward edge portions of said sidewalls and forward surface portions of said first and second upstanding members comprising forward attaching portions of said closet unit, said forward attaching portions being positioned adjacent to the rear surface portions of the posts and being attached thereto;
c. a door unit comprising a pair of trim molding panels and a door means positioned at said entryway area, said trim molding panels positioned against the lateral surfaces of the vertical post in a manner to overlap said vertical posts and said forward edge portions of said sidewalls, whereby said trim molding panels and said sidewalls form a finished interior surface of said closet unit.

3. The combination structure recited in claim 2, wherein said first and second upstanding sidewalls each include an integral horizontal ledge portion supporting a platform thereon, said sidewalls each having a platform positioning sidewall portion extending upwardly above its related ledge portion for positioning said platform, said platform locating sidewall portions being positioned more closely to one another than the interior surfaces of the sidewalls other than the platform locating sidewall portions above the ledges, whereby the sidewalls of the closet may be made greater than a standard dimension, while the ledges are able to provide said support platform of a standard dimension.

4. The structure as recited in claim 3, further comprising securing sidewall portions being positioned below related ledge portions and spaced inwardly from interior surfaces of said sidewalls, a rod member extending between securing sidewall portions and attached to said structure at said securing sidewall portions.

5. The structure as recited in claim 4, further comprising block means positioned against outside surfaces of said securing sidewall portions, support collar means positioned adjacent inner surfaces of said securing sidewall portions, securing means connecting said support collar means to said securing sidewall portions, with said horizontal rod member extending between and supported by said support collar means.

6. A preformed storage unit, having a lengthwise axis and a transverse axis, for installation within a building wall frame opening which is formed by first and second spaced apart upstanding framing members, the storage unit comprising:
a. an interior compartment portion having an inner surface and an outer surface, and further including first and second upstanding sidewalls which are integrally joined to an upstanding transverse rear wall;
b. an exterior frame including an inner surface which is positioned about the outer surface of the interior compartment portion, and an outer surface, the exterior frame including
(1) a lower base including first and second lengthwise horizontal members which are connected to a rear transverse horizontal member,
(2) an upper base including first and second lengthwise members which are connected to a rear transverse horizontal member, and
(3) first and second upstanding members which are connected between forward end portions of the first and second lengthwise members of the upper and lower base, respectively;
c. means for connecting the interior compartment portion to the exterior frame;
d. means for fastening the first and second upstanding members of the exterior frame to the first and second upstanding framing members;
e. said first and second upstanding sidewalls each including an integral horizontal ledge portion supporting a platform thereon, said sidewalls each having a platform positioning sidewall portion extending upwardly above its related ledge portion for positioning said platform, said platform locating sidewall portions being positioned more closely to one another than the interior surfaces of the sidewalls other than the platform locating sidewall portions above the ledges, whereby the sidewalls of the closet may be made greater than a standard dimension, while the ledges are able to provide said support platform of a standard dimension.

7. The unit as recited in claim 6, further comprising securing sidewall portions being positioned below related ledge portions and spaced inwardly from interior surfaces of said sidewalls, a rod member extending between securing sidewall portions and attached to said structure at said securing sidewall portions.

8. The unit as recited in claim 7, further comprising block means positioned against outside surfaces of said securing sidewall portions, support collar means positioned adjacent inner surfaces of said securing sidewall portions, securing means connecting said support collar means to said securing sidewall portions, with said horizontal rod member extending between and supported by said support collar means.

* * * * *